US005264110A

United States Patent [19]

Atkinson et al.

[11] Patent Number: 5,264,110

[45] Date of Patent: Nov. 23, 1993

[54] ELECTROLYTIC SQUARE WAVE GRAINING

[75] Inventors: Philip A. Atkinson, Gledhow; Nicholas J. Brattan, Oakwood, both of United Kingdom

[73] Assignee: DuPont-Howson Ltd. of Coal Road, Seacroft, United Kingdom

[21] Appl. No.: 845,863

[22] Filed: Mar. 3, 1992

Related U.S. Application Data

[63] Continuation of Ser. No. 662,560, Feb. 28, 1991, abandoned.

[30] Foreign Application Priority Data

Mar. 6, 1990 [GB] United Kingdom ..... 9005035

[51] Int. Cl.[5] ..... C25D 5/44; C25F 3/04

[52] U.S. Cl. ..... 205/214; 204/129.4; 204/129.75; 204/DIG. 9

[58] Field of Search ..... 204/129.4, 129.75, DIG. 9; 205/214

[56] References Cited

U.S. PATENT DOCUMENTS

| | | | |
|---|---|---|---|
| 4,087,341 | 5/1978 | Takahashi et al. | 204/129.43 |
| 4,297,184 | 10/1981 | Dyer | 204/DIG. 9 X |
| 4,482,434 | 11/1984 | Pliefke | 204/DIG. 9 X |
| 4,561,944 | 12/1985 | Sasaki et al. | 204/DIG. 9 X |
| 4,681,672 | 7/1987 | Kojima et al. | 204/129.4 |
| 4,686,021 | 8/1987 | Nakanishi et al. | 204/DIG. 9 X |
| 4,741,812 | 5/1988 | Kojima et al. | 204/129.4 |
| 5,045,157 | 9/1991 | Nishino et al. | 205/214 |
| 5,141,605 | 8/1992 | Nishino et al. | 204/129.4 X |

*Primary Examiner*—Donald R. Valentine

*Attorney, Agent, or Firm*—Reed Smith Shaw & McClay

[57] ABSTRACT

A method of electrolytically graining aluminium, aluminium alloy or aluminium laminate, desirably in a substantially uniform manner, in particular for use as a lithographic printing plate substrate, is disclosed wherein the graining is effected using a square wave alternating current.

30 Claims, 5 Drawing Sheets

ELECTROLYTIC SQUARE WAVE GRAINING

Figure 1A:
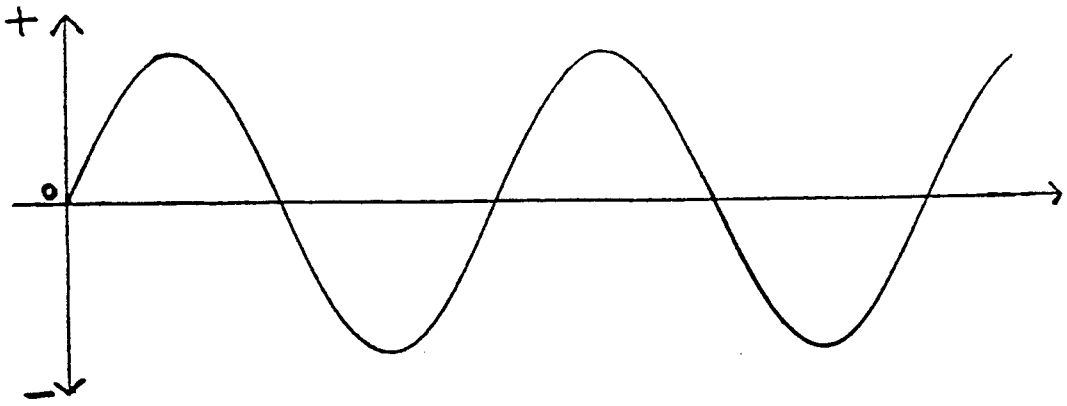

This application is a continuation of Ser. No. 07/622,560, filed Feb. 28, 1991, now abandoned.

This invention relates to the electrolytic graining of aluminium, aluminium alloys and aluminium laminates and more particularly, but not exclusively, is concerned with the electrolytic graining of aluminium, aluminium alloys or aluminium laminates in the production of substrates suitable for use in the manufacture of radiation sensitive plates in lithographic printing plate production.

Radiation sensitive plates of the type with which this invention is concerned conventionally consist of a substrate onto which is coated a radiation sensitive composition. Image-wise exposure of the plate to radiation causes the coating to change its characteristics in the areas struck by radiation so that the coating may be selectively removed from the substrate in the non-image areas by application of a suitable developer to leave a printing image (or etch resistant area) on the substrate. In the case of the so-called negative-working devices, it is the non-radiation struck areas of the coating which are removed. Those parts of the coating which are not removed and which thus form the printing image are ordinarily water-repellent and ink-receptive and those parts of the substrate revealed on development are ordinarily water-receptive and ink-repellent.

It will be apparent that the surface of the substrate should be such that the printing image can strongly adhere thereto and such that it is readily wettable with water. It is known to improve the adhesion of the printing image and to improve the wetting characteristics of the non-image areas by roughening (conventionally referred to as graining) the substrate before applying the radiation sensitive coating.

The coarseness or surface roughness of the grained substrate can be characterised, for example, by measurement of a centre line average (CLA).

The type of grain required for the substrate of a radiation sensitive printing plate for lithographic printing plate production depends upon the requirements of the final printing plate. Thus a fine grain—i.e. shallow depressions—results in better reproduction of half-tones whereas a coarse grain—i.e. deep depressions—results in the non-image areas having better wetting characteristics. In either case however it is important that the depressions are evenly spaced over the substrate surface and that they are close enough together so that peaks, rather than plateaux, are formed between the depressions.

It is known to grain substrates in lithographic printing plate production by electrolytic techniques. Graining is normally effected by immersing the substrates in a suitable electrolyte and subjecting them to a sine waveform alternating current.

Conventionally, hydrochloric acid has been used as the electrolyte for graining aluminium and aluminium alloy substrates. However, when using hydrochloric acid it is difficult to obtain a fine homogeneous grain and it is therefore necessary carefully to control the acid concentration of the electrolyte in order to ensure consistent results. This is particularly the case when aluminium alloys such as 3103 aluminium maganese alloy are used as the substrate. The use of such alloys for the substrate can be particularly advantageous due to their increased resistance to tearing and cracking and to temperatures in excess of 200° C. which are used to harden the image on the printing plate and thus to increase the printing run length.

It is known to grain aluminium substrates using as the electrolyte a mixture of hydrochloric and phosphoric acids. Whilst this method can result in an even grain, an excessive amount of smut is produced on the substrate which can cause the radiation sensitive coating of the plate to become insolubilised during storage of the plate. Thus the smut has normally to be removed. A further disadvantage of using a hydrochloric acid/phosphoric acid mixture as electrolyte is that the process is inflexible in respect of the type of grain which can be produced.

The use of hydrochloric acid or hydrochloric acid/phosphoric acid mixtures is further disadvantageous when using certain aluminium alloys since both these electrolytes attack the impurities in the alloy and thus cause pitting of the surface.

It is also known to use as the electrolyte hydrochloric acid in combination with monocarboxylic acids having between 1 and 4 carbon atoms. By this method aluminium and aluminium alloy substrates having a fine homogeneous grain structure can be produced. However, complicated analytical techniques are required to monitor the relative amounts of hydrochloric acid and monocarboxylic acid. Moreover, the use of additives to the hydrochloric acid electrolyte such as monocarboxylic acids can be environmentally undesirable.

It is an object of the present invention to provide a method of electrolytically graining aluminium and aluminium alloys and aluminium laminates which results in a fine homogeneous grain structure and which obviates the need for complex chemical analysis of the electrolyte.

It has surprisingly been found that in the electrolytic graining of aluminium, aluminium alloys or aluminium laminates, a fine homogeneous grain structure can be achieved by the use of an alternating current having a square waveform rather than the conventional alternating current having a sine waveform.

Accordingly the present invention provides a method of electrolytically graining a sheet of aluminium, aluminium alloy or aluminium laminate which comprises immersing the sheet in an aqueous electrolyte and passing an alternating current through the electrolyte wherein the alternating current has a square waveform.

Generally hydrochloric acid is used, and the concentration of hydrochloric acid in the electrolyte will be from 3 to $2gl^{-1}$ and the electrolytic graining may preferably be effected at a voltage of, for example, 5 V to 45 V, particularly preferably from 10 V to 35V for 15 seconds to 4 minutes to give a surface roughness characterised by a centre line average (CLA), as measured, for example, by a Rank Taylor Hobson Talysurf 10, of from 0.3 to 1.0 microns. The electrolyte may be at any suitable temperature but preferably from 25° to 34° C. An alternative to the above is to use nitric acid in which case concentrations of between 5 and 30 $gl^{-1}$ may be used.

The frequency of the alternating square wave current will preferably be from 20 to 100 Hz and particularly preferably from 40 to 70Hz. The voltage in each half cycle can be chosen as desired within the preferred range. The preferred ratios of the voltage in the positive and negative half cycles are within the range of from 1:2 to 1:1, positive: negative. It is also possible to vary the time period of each half-cycle whilst maintaining the frequency within the preferred range. The preferred range for the ratio of the time periods in the positive and negative half cycles is from 1:2 to 1:1, positive: negative.

The graining may be effected by immersing the aluminium, aluminium alloy or aluminium laminate sheet in the electrolyte, the square waveform alternating current being passed through the electrolyte using the sheet as an electrode. A second similar sheet may be used as the second electrode. Alternatively the graining may be effected as a continuous process by passing a continuous web of aluminium, aluminium alloy or aluminium laminate through the electrolyte. In this case the electrodes used to introduce the square waveform alternating current may, for example, be carbon electrodes located near to the web.

After graining, the aluminium, aluminium alloy or aluminium laminate may be anodised in a suitable electrolyte, preferably using direct current. Thereafter the grained surface (or the grained and anodised surface, as the case may be) of the sheet may be coated with a radiation sensitive composition to form a radiation sensitive plate. The radiation sensitive composition may be a positive working composition such as a mixture of a guinone diazode and a novolak resin or a negative working composition, such as a photopolymerisable resin. The radiation sensitive plate may then be imagewise exposed and suitably processed to produce a lithographic printing plate.

Figure 1B:
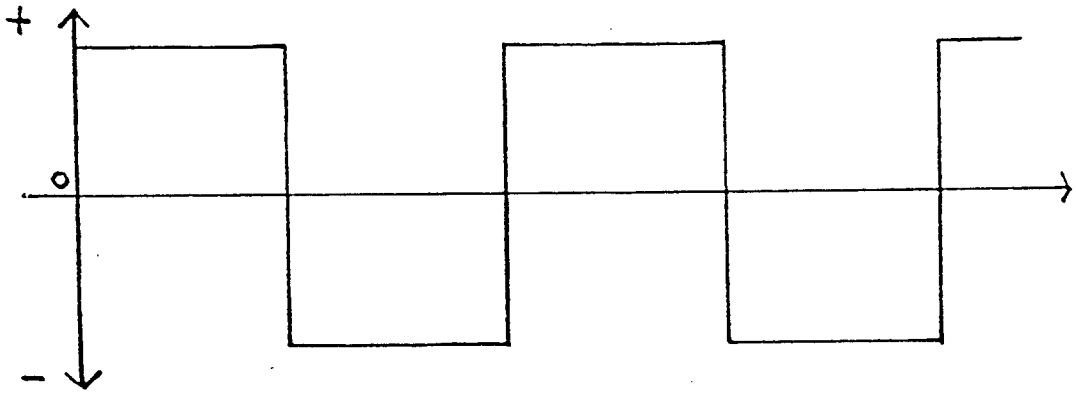
Figure 2:
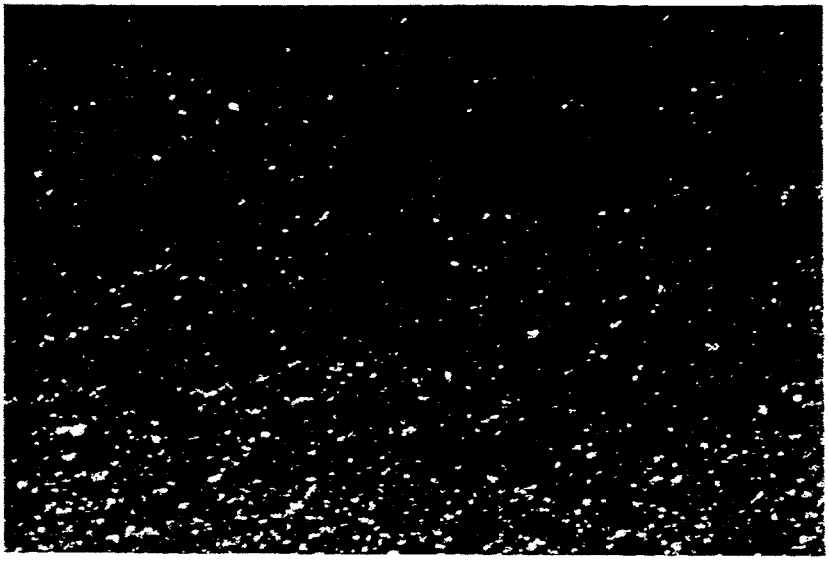
Figure 3:
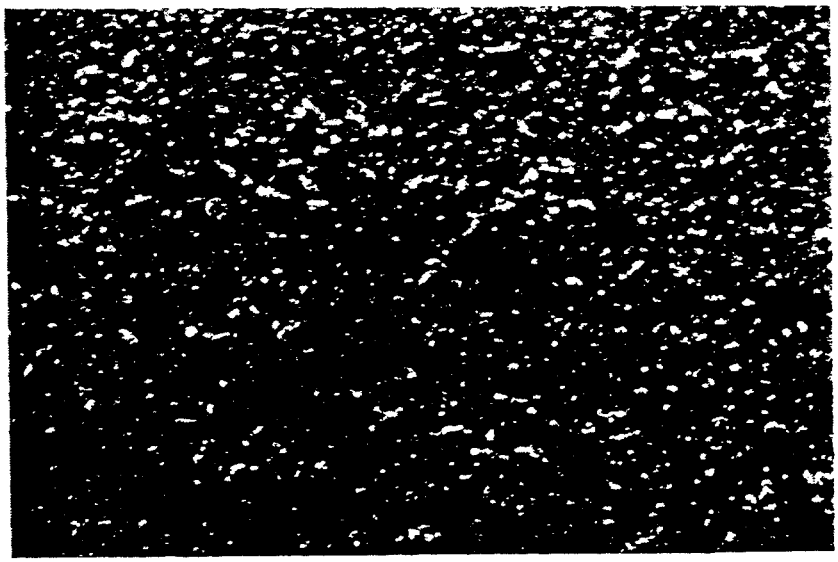
Figure 4:
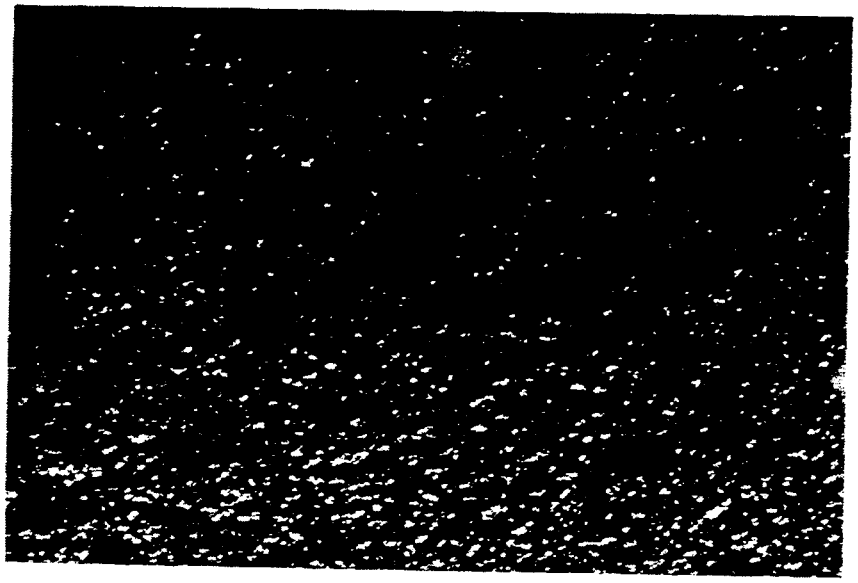
Figure 5:
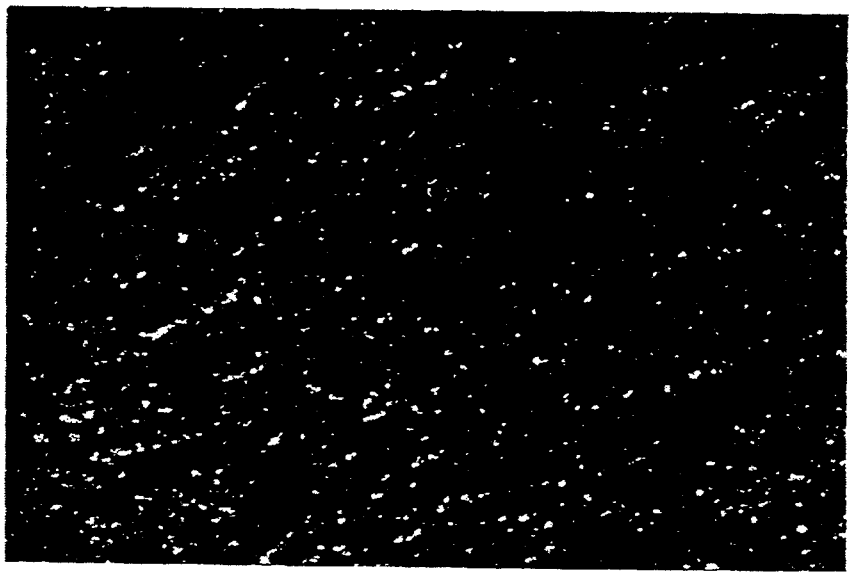

For a better understanding of the invention, and to show how the same may be carried into effect, reference will be made, by way of example only, to the following figures in which:

FIGS. 1*a* and 1*b* illustrate the waveform associated respectively with a sine waveform and a square waveform alternating current, FIGS. 2 to 5 are electron micrographs of electrolytical grained sheets of 3103 grade aluminium-manganese alloy, of which FIG. 2 shows a sheet of the alloy grained in accordance with the present invention, FIG. 3 shows a sheet of the alloy grained in hydrochloric acid electrolyte, using a sine waveform alternating current, FIG. 4 shows a sheet of the alloy grained in hydrochloric acid electrolyte with added monocarboxylic acid using a sine waveform alternating current, and FIG. 5 shows a sheet of the alloy grained in hydrochloric acid electrolyte with added monocarboxylic acid using a square waveform alternating current.

Figure 6:
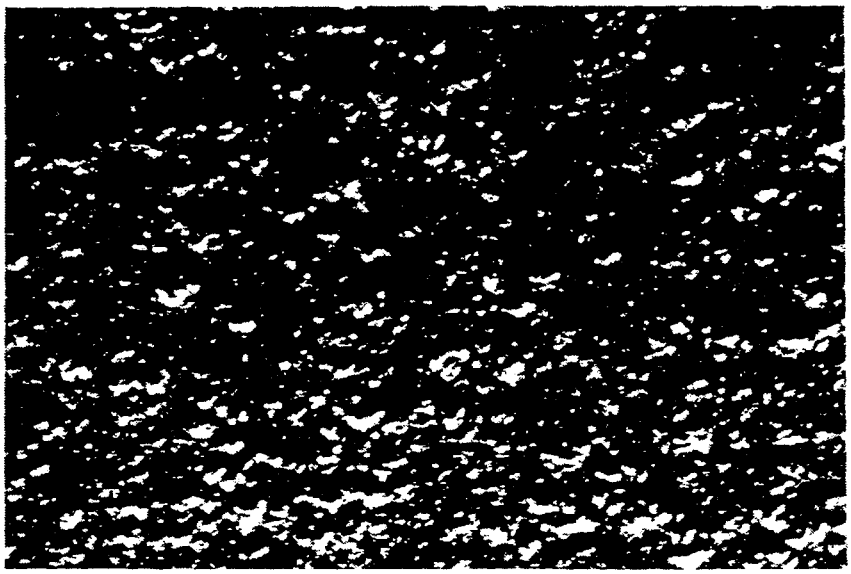
Figure 7:
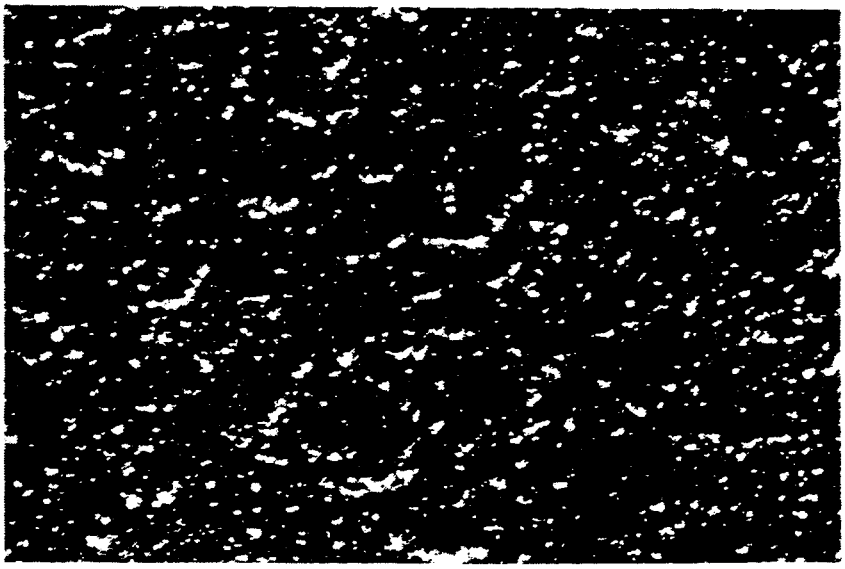
Figure 8:
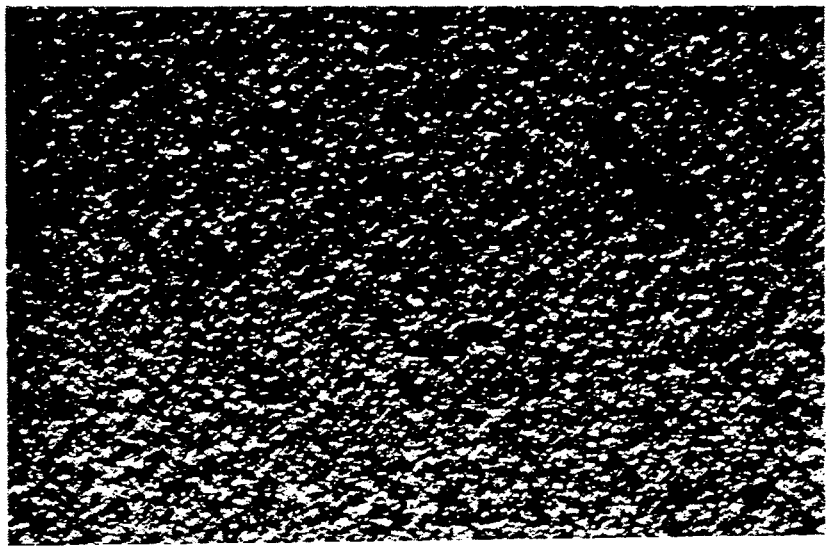
Figure 9:
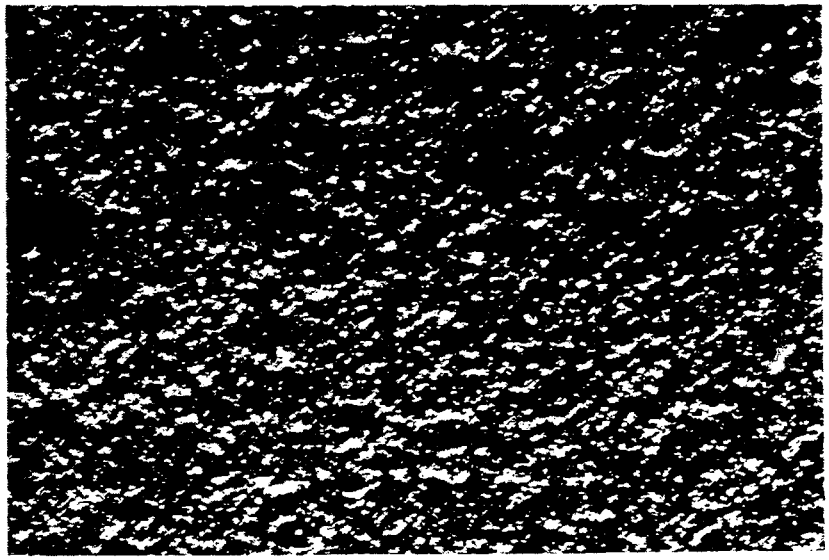

FIGS. 6 to 9 are electron micrographs of electrolytically grained sheet of 1050 grade aluminium, of which FIG. 6 shows a sheet of the aluminium grained in accordance with the present invention, FIG. 7 shows a sheet of the aluminium grained in hydrochloric acid electrolyte using a sine waveform alternating current, FIG. 8 shows a sheet of the aluminium grained in hydrochloric acid electrolyte with added monocarboxylic acid using a sine waveform alternating current, and FIG. 9 shows a sheet of the aluminium grained in hydrochloric acid electrolyte with added monocarboxylic acid using a square waveform alternating current.

The following examples illustrate the invention:

EXAMPLE 1

Sheets of 3103 grade aluminium-manganese alloy were degreased in 10 to 20 $gl^{31\ 1}$ sodium hydroxide for 30s at 35° to 40° C. and rinsed. The sheets were then electrolytically grained using hydrochloric acid at a concentration of 7 $gl^{-1}$ and a temperature of 26° to 28° C. and using a square waveform alternating current at an applied voltage of 16 to 18 V and at a frequency of 50 Hz. The resulting grained sheets had a CLA of 0.6 to 0.8 microns. Part of the surface of one sheet is shown in FIG. 2.

COMPARATIVE EXAMPLE 1

Sheets of 3103 grade aluminium-manganese alloy were degreased, rinsed and grained as in Example 1, but using a sine waveform alternating current. The resulting grained sheets had a CLA of 0.6 to 0.8 microns. Part of the surface of one sheet is shown in FIG. 3.

COMPARATIVE EXAMPLE 2

Sheets of 3103 grade aluminium-manganese alloy were degreased and rinsed as in Example 1. The sheets were then electrolytically grained using an electrolyte comprising 8 to 10 $gl^{-1}$ hydrochloric acid and 15 to 30 $gl^{-1}$ of a monocarboxylic acid at a temperature of 26° to 28° C. and using a sine waveform alternating current at an applied voltage of 16 to 18 V and frequency of 50 Hz. The resulting grained sheets had a CLA of 0.6 to 0.8 microns. Part of the surface of one of the sheets is shown in FIG. 4.

COMPARATIVE EXAMPLE 3

Sheets of 3103 grade aluminium-manganese alloy were degreased, rinsed and grained as in Comparative Example 2, but using a square waveform alternating current. The resulting grained sheets had a CLA of 0.6 to 0.8 microns. Part of the surface of one of the sheets is shown in FIG. 5.

EXAMPLE 2

Sheets of 1050 grade aluminium (99.5% Al) were degreased, rinsed and grained using the same conditions as Example 1. Part of the surface of one of the sheets is shown in FIG. 6

COMPARATIVE EXAMPLE 4

Sheets of 1050 grade aluminium were degreased, rinsed and grained using the same conditions as Comparative Example 1. Part of the surface of one of the sheets is shown in FIG. 7.

COMPARATIVE EXAMPLE 5

Sheets of 1050 grade aluminium were degreased, rinsed and grained using the same conditions as Comparative Example 2 . Part of the surface of one of the sheets is shown in FIG. 8.

COMPARATIVE EXAMPLE 6

Sheets of 1050 grade aluminium were degreased, rinsed and grained using the same conditions as Comparative Example 3. Part of the surface of one of the sheets is shown in FIG. 9.

EXAMPLE 3

Sheets of 3103 grade aluminium-manganese alloy were degreased in 10 to 20 $gl^{-1}$ sodium hydroxide for 30 seconds at 35° to 40° C. and rinsed. The sheets were then electrolytically grained using nitric acid at a concentration of 16 $gl^{-1}$ and a temperature of 26°-28° C. A square waveform at a frequency of 50 Hz and voltage of 18-20 V was used. The resulting grained sheets had a CLA of 0.6 to 0.8 microns.

COMPARATIVE EXAMPLE 7

Sheets of 3103 grade aluminium-manganese alloy were degreased, rinsed and grained as in Example 7, but using a sine waveform. The resulting grained sheets had a CLA of 0.6 to 0.8 microns.

Comparison of FIG. 2 with FIG. 3 and FIG. 6 with FIG. 7 clearly shows that when using a standard hydrochloric acid electrolyte in the graining of aluminium or aluminium alloys the use of a square waveform alternating current instead of the conventional sine waveform results in a significantly finer and more homogeneous substrate surface.

Comparison of FIGS. 2 and 6 with FIGS. 4 and 8 respectively demonstrates that the grained aluminium or aluminium alloy substrate obtained by use of a standard hydrochloric acid electrolyte with a square waveform alternating current has an equally fine and homogeneous surface as that obtained by use of a mixed hydrochloric acid/monocarboxylic acid electrolyte and a sine waveform alternating current. Furthermore it can be seen from FIGS. 5 and 9 that no further advantage is gained by using a mixed hydrochloric acid/monocarboxylic acid electrolyte with a square waveform alternating current. Moreover, such a method is disadvantageous because of the technical complexity of monitoring the relative hydrochloric acid and monocarboxylic acid concentrations.

We claim:

1. A method of electrolytically graining an aluminium containing substrate which method comprises providing one member selected from the group comprising aluminium sheets, aluminium alloy sheets, and aluminium laminate sheets, immersing the said sheet in an aqueous electrolyte, the electrolyte containing hydrochloric acid, at a concentration in the range of from 3 to 20 g/l, and passing an alternating current through the said electrolyte, wherein the alternating current has a square wave form.

2. A method according to claim 1, wherein the graining is effected at a voltage in the range of from 5 to 45 V.

3. A method according to claim 1, wherein the graining is effected for from 15 seconds to 4 minutes.

4. A method according to claim 1, wherein the frequency of said alternating current lies within the range 20 to 100 Hz.

5. A method according to claim 1, wherein said square wave form has both a positive and a negative half cycle and wherein the ratio of the voltages in said positive and negative half cycles is in the range of from 1:1 to 1:2.

6. A method according to claim 1, wherein said square wave form has positive and negative half cycles having a temporal ratio in the range of from 1:2 to 1:1.

7. A method according to claim 1, wherein at least one electrode comprises a sheet or aluminium, aluminium alloy or aluminium laminate.

8. A method according to claim 1, wherein a continuous web of aluminium, aluminium alloy or aluminium laminate is passed through the electrolyte.

9. A method according to claim 1, including a stage in which the grained surface is anodised.

10. A method according to claim 1, including a final stage comprising coating the substrate with a radiation sensitive composition.

11. A method of electrolytically graining an aluminium containing substrate which method comprises providing one member selected from the group comprising aluminium sheets, aluminium alloy sheets, and aluminium laminate sheets, immersing said sheet in an aqueous electrolyte, wherein the electrolyte contains one member of the group comprising hydrochloric acid, at a concentration in the range of from 3 to 20 g/l and nitric acid, in the concentration range of from 5 to 30 g/l, passing an alternating current through said electrolyte wherein the alternating current has a square wave form and effecting the graining at a voltage in the range of from 5 to 45 V.

12. A method according to claim 11, wherein the graining is effected for from 15 seconds to 4 minutes.

13. A method according to claim 11, wherein the frequency of said alternating current lies within the range 20 to 100 Hz.

14. A method according to claim 11, wherein said square wave form has both a positive and a negative half cycle and wherein the ratio of the voltages in said positive and negative half cycles is in the range of from 1:1 to 1:2.

15. A method according to claim 11, wherein said square wave form has positive and negative half cycles having a temporal ratio in the range of from 1:2 to 1:1.

16. A method according to claim 11, wherein at least one electrode comprises a sheet of aluminium, aluminium alloy, or aluminium laminate.

17. A method according to claim 11, wherein a continuous web of aluminium, aluminium alloy, or aluminium laminate is passed through the electrolyte.

18. A method according to claim 11, including a stage in which the grained surface is anodised.

19. A method according to claim 11, including a final stage comprising coating the substrate with a radiation sensitive composition.

20. A method of electrolytically graining an aluminium containing substrate which method comprises providing one member selected from the group comprising aluminium sheets, aluminium alloy sheets, and aluminium laminate sheets, immersing said sheet in an aqueous electrolyte, wherein the electrolyte contains one member of the group comprising hydrochloric acid, at a concentration in the range of from 3 to 20 g/l and nitric acid, in the concentration range of from 5 to 30 g/l, passing an alternating current through said electrolyte wherein the alternating current has a square wave form, effecting the graining for from 15 seconds to 4 minutes, wherein the frequency of said alternating current lies within the range 20 to 100 Hz, wherein said square wave form has both a positive and a negative half cycle and wherein the ratio of the voltages in said positive and negative half cycles is in the range of from 1:1 to 1:2.

21. A method according to claim 20, wherein said square wave form has positive and negative half cycles having a temporal ratio in the range of from 1:2 to 1:1.

22. A method according to claim 20, wherein at least one electrode comprises a sheet of aluminium, aluminium alloy, or aluminium laminate.

23. A method according to claim 20, wherein a continuous web of aluminium, aluminium alloy, or aluminium laminate is passed through the electrolyte.

24. A method according to claim 20, including a stage in which the grained surface is anodised.

25. A method according to claim 20, including a final stage comprising coating the substrate with a radiation sensitive composition.

26. A method of electrolytically graining an aluminium containing substrate which method comprises providing one member selected from the group comprising aluminium sheets, aluminium alloy sheets, and aluminium laminate sheets, immersing said sheet in an aqueous electrolyte, wherein the electrolyte contains one member of the group comprising hydrochloric acid, at a concentration in the range of from 3 to 20 g/l and nitric acid, in the concentration range of from 5 to 50 g/l, passing an alternating current through the said electrolyte wherein the alternating current has a square wave form, effecting the graining for from 15 seconds to 4 minutes, wherein the frequency of said alternating current lies within the range 20 to 100 Hz and wherein said square wave form has positive and negative half cycles having a temporal ratio in the range of from 1:2 to 1:1.

27. A method according to claim 26, wherein at least one electrode comprises a sheet of aluminium, aluminium alloy, or aluminium laminate.

28. A method according to claim 26, wherein a continuous web of aluminium, aluminium alloy, or aluminium laminate is passed through the electrolyte.

29. A method according to claim 26, including a stage in which the grained surface is anodised.

30. A method according to claim 26, including a final stage comprising coating the substrate with a radiation sensitive composition.

* * * * *

UNITED STATES PATENT AND TRADEMARK OFFICE

CERTIFICATE OF CORRECTION

PATENT NO. : 5,264,110
DATED : November 23, 1993
INVENTOR(S) : Atkinson et al.

It is certified that error appears in the above-indentified patent and that said Letters Patent is hereby corrected as shown below:

Col. 1, line 4, delete "07/622,560", and substitute therefor —07/662,560—.

Col. 1, line 65, delete "maganese", and substitute therefor —manganese—.

Col. 2, line 5, delete "phosphos-", and substitute therefor —phosphoric—.

Col. 2, line 6, delete "phoric".

Col. 2, line 50, delete "$2gl^{-1}$", and substitute therefor —$20gl^{-1}$—.

Col. 3, line 24, delete "guinone", and substitute therefor —quinone—.

Col. 3, line 67, delete "$20gl^{31\ 1}$", and substitute therefor —$20gl^{-1}$—.

Col. 5, line 4, delete "7", and substitute therefor —3—.

Signed and Sealed this

Fourth Day of October, 1994

*Attest:*

*Attesting Officer*

BRUCE LEHMAN

*Commissioner of Patents and Trademarks*